US012139844B2

(12) United States Patent
Jang et al.

(10) Patent No.: US 12,139,844 B2
(45) Date of Patent: Nov. 12, 2024

(54) CLOTHING DRYER

(71) Applicant: Samsung Electronics Co., Ltd., Suwon-si (KR)

(72) Inventors: Wonjun Jang, Suwon-si (KR); Hooijoong Kim, Suwon-si (KR); Eungryeol Seo, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 1019 days.

(21) Appl. No.: 17/013,369

(22) Filed: Sep. 4, 2020

(65) Prior Publication Data

US 2021/0062401 A1 Mar. 4, 2021

(30) Foreign Application Priority Data

Sep. 4, 2019 (KR) ..... 10-2019-0109651

(51) Int. Cl.
*D06F 58/24* (2006.01)
*D06F 58/20* (2006.01)

(52) U.S. Cl.
CPC ..... *D06F 58/24* (2013.01); *D06F 58/206* (2013.01)

(58) Field of Classification Search
CPC ..... D06F 58/24; D06F 58/206
See application file for complete search history.

(56) References Cited

U.S. PATENT DOCUMENTS 6,688,345 B1 2/2004 Iglesias et al.
9,617,680 B2 4/2017 Kitayama et al.
10,662,575 B2 5/2020 Ahn et al.
10,738,412 B2 8/2020 Bae
2005/0132601 A1 6/2005 Doh
2008/0235977 A1 10/2008 Kuwabara
2011/0289695 A1* 12/2011 Colin ..... D06F 58/206 68/5 B
2018/0142408 A1 5/2018 Ahn et al.
2021/0047775 A1* 2/2021 Lee ..... D06F 25/00

FOREIGN PATENT DOCUMENTS

AU 2017 374 402 A1 8/2019
EP 2 549 007 A1 1/2013
JP 2011-167574 A 9/2011
KR 10-2002-0029381 A 4/2002
KR 10-0664283 B1 1/2007
(Continued)

OTHER PUBLICATIONS

Supplementary European Search Report dated Jul. 22, 2022 in connection with European Patent Application No. 20 86 1599, 8 pages.

(Continued)

*Primary Examiner* — Edelmira Bosques
*Assistant Examiner* — Bao D Nguyen

(57) ABSTRACT

Disclosed herein is a clothing dryer. The clothing dryer includes a main body, a drum rotatably installed in the main body, a first motor configured to transmit a rotational force to the drum, a heat pump configured to heat air supplied to the drum and including an evaporator, a compressor, a condenser, and an expansion valve, a flow path connected to the drum to circulate air; and a second motor disposed in the flow path and configured to drive a fan to flow air.

15 Claims, 10 Drawing Sheets

(56) References Cited

FOREIGN PATENT DOCUMENTS

| | | | |
|---|---|---|---|
| KR | 10-2009-0016916 | A | 2/2009 |
| KR | 10-2012-0015012 | A | 2/2012 |
| KR | 10-1191206 | B1 | 10/2012 |
| KR | 10-2016-0149852 | A | 12/2016 |
| KR | 10-2018-0078082 | A | 7/2018 |
| WO | 2018/110935 | A1 | 6/2018 |

OTHER PUBLICATIONS

Communication pursuant to Article 94(3) EPC dated Aug. 11, 2023, in connection with European Patent Application No. 20861599.7, 4 pages.
International Search Report dated Dec. 17, 2020 in connection with International Patent Application No. PCT/KR2020/010986, 3 pages.
Communication pursuant to Article 94(3) EPC dated Sep. 20, 2024, in connection with European Patent Application No. 20861599.7, 4 pages.
Notice of submission of opinion dated Sep. 11, 2024, in connection with Korean Patent Application No. 10-2019-0109651, 12 pages.

* cited by examiner

CLOTHING DRYER

CROSS-REFERENCE TO RELATED APPLICATION

This application is based on and claims priority to Korean Patent Application No. 10-2019-0109651 filed on Sep. 4, 2019 in the Korean Intellectual Property Office, the disclosure of which is incorporated by reference herein in its entirety.

BACKGROUND

1. Field

Embodiments of the disclosure relate to a clothing dryer, and more particularly, to a clothing dryer having an improved air flow.

2. Description of the Related Art

In general, a clothing dryer refers to an apparatus used to dry wet laundry inserted into a drying tub by forcibly blowing hot air into the drying tub. Clothing dryers basically have similar appearances to those of drum washing machines and dry wet laundry by forcibly circulating hot air into a drying tub by using a heater and a blowing fan.

Clothing dryers may include condensation type dryers and exhaust type dryers.

In condensation type dryers, air is heat-exchanged with wet laundry in a drying tub to form hot and humid air, which is not discharged out of the dryer but circulated therein, and condensate formed via heat-exchange between the air and external air using a separate condenser is discharged to the outside.

In exhaust type dryers, hot and humid air obtained after air is heat-exchanged with wet laundry in a drying tub is directly discharged out of the dryers.

Among them, condensation type dryers have been widely used due to the advantages of low energy consumption and high thermal efficiency by using a heat pump.

However, in condensation type dryers using a heat pump, an air flow path is formed in a shape causing high resistance while air flows therein, and thus flow path loss and noise occur.

SUMMARY

In accordance with an aspect of the present disclosure a clothing dryer is provided having an improved air flow.

In accordance with another aspect of various embodiments of the present disclosure a clothing dryer is provided having a reduced flow loss by simplifying a shape of a flow path.

In accordance with another aspect of various embodiments of the present disclosure a clothing dryer capable of reducing noise by installing a fan motor in a flow path without spatial limitations is provided.

Additional aspects of the disclosure will be set forth in part in the description which follows and, in part, will be obvious from the description, or may be learned by practice of the disclosure.

According to various embodiments, a clothing dryer includes: a main body; a drum rotatably installed in the main body; a first motor configured to transmit a rotational force to the drum; a heat pump configured to heat air supplied into the drum and including an evaporator, a compressor, a condenser, and an expansion valve; a flow path connected to the drum to circulate air; and a second motor disposed in the flow path and configured to drive a fan for flowing air.

According to various embodiments of the disclosure, the flow path may include a connection flow path to accommodate the evaporator and the condenser, the connection flow path may include an air outlet to discharge air toward the drum, and the air outlet may be eccentrically located closer to the condenser than the first motor.

According to various embodiments of the disclosure, the clothing dryer may further include a duct forming the flow path, wherein the second motor is located in the duct.

According to various embodiments of the disclosure, the air outlet may be located in a line where the second motor is located.

According to various embodiments of the disclosure, the clothing dryer may include a first region in which the first motor is located, and a second region located parallel to the first region, wherein the second motor is located in the second region.

According to various embodiments of the disclosure, an axis of the second motor may be arranged parallel to an axis of the first motor.

According to various embodiments of the disclosure, the duct may include a first heat dissipation port configured to dissipate heat of the second motor.

According to various embodiments of the disclosure, the clothing dryer may further include a motor bracket configured to accommodate the second motor.

According to various embodiments of the disclosure, the motor bracket may be configured to cover at least one portion of the second motor and include a second heat dissipation port to dissipate heat of the second motor.

According to various embodiments of the disclosure, the first heat dissipation port and the second heat dissipation port may be formed at positions corresponding to each other.

According to various embodiments of the disclosure, the motor bracket may further include an anti-vibration member to reduce vibration between the motor bracket and the second motor.

According to various embodiments of the disclosure, the duct may include a hot air discharge duct connected to the drum to discharge air from the drum, a connection duct connected to the hot air discharge duct and forming the connection flow path, and a hot air guide duct connected to the connection duct and configured to guide air sequentially through the evaporator, the condenser, and the second motor and resupply the air to the drum.

According to various embodiments of the disclosure, the flow path may include a discharge flow path connecting the drum with the connection duct, a connection flow path connected to the discharge flow path and sequentially accommodating at least one component of the heat pump and the second motor, and a guide flow path connecting the connection flow path with the drum.

According to various embodiments of the disclosure, the motor bracket may include a guide duct to guide air of the connection flow path to the drum.

According to various embodiments of the disclosure, a clothing dryer includes: a drum rotatably installed in a main body; a duct connected to the drum and forming a flow path for air circulation; a heat pump configured to heat air supplied to the drum and including an evaporator, a compressor, a condenser, and an expansion valve; a first motor configured to drive the drum; and a second motor configured to drive a fan provided to flow air in the flow path, wherein the second motor is located in the duct.

According to various embodiments of the disclosure, the first motor and the second motor may be arranged to have axes parallel to each other.

According to various embodiments of the disclosure, the second motor may be eccentrically arranged closer to the condenser.

According to various embodiments of the disclosure, the flow path may include a connection flow path accommodating the evaporator and the condenser, the connection flow path may include an air outlet to discharge air toward the drum, and the air outlet is disposed closer to the condenser than the first motor.

According to various embodiments of the disclosure, the duct may include a first heat dissipation port configured to dissipate heat of the second motor.

According to various embodiments of the disclosure, the clothing dryer may include a motor bracket configured to accommodate the second motor, wherein the motor bracket includes a guide duct configured to guide air of the flow path to the drum, and a second heat dissipation port configured to dissipate heat of the second motor.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like.

Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

FIGS. 1 through 10, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged system or device.

Hereinafter, embodiments of the present disclosure will be described in detail with reference to the accompanying drawings. Meanwhile, the terms used throughout the specification "front end", "rear end", "upper", "lower", "upper end", and lower end", and the like are defined based on the drawings and the shape and position of each element are not limited by these terms.

Figure 1:
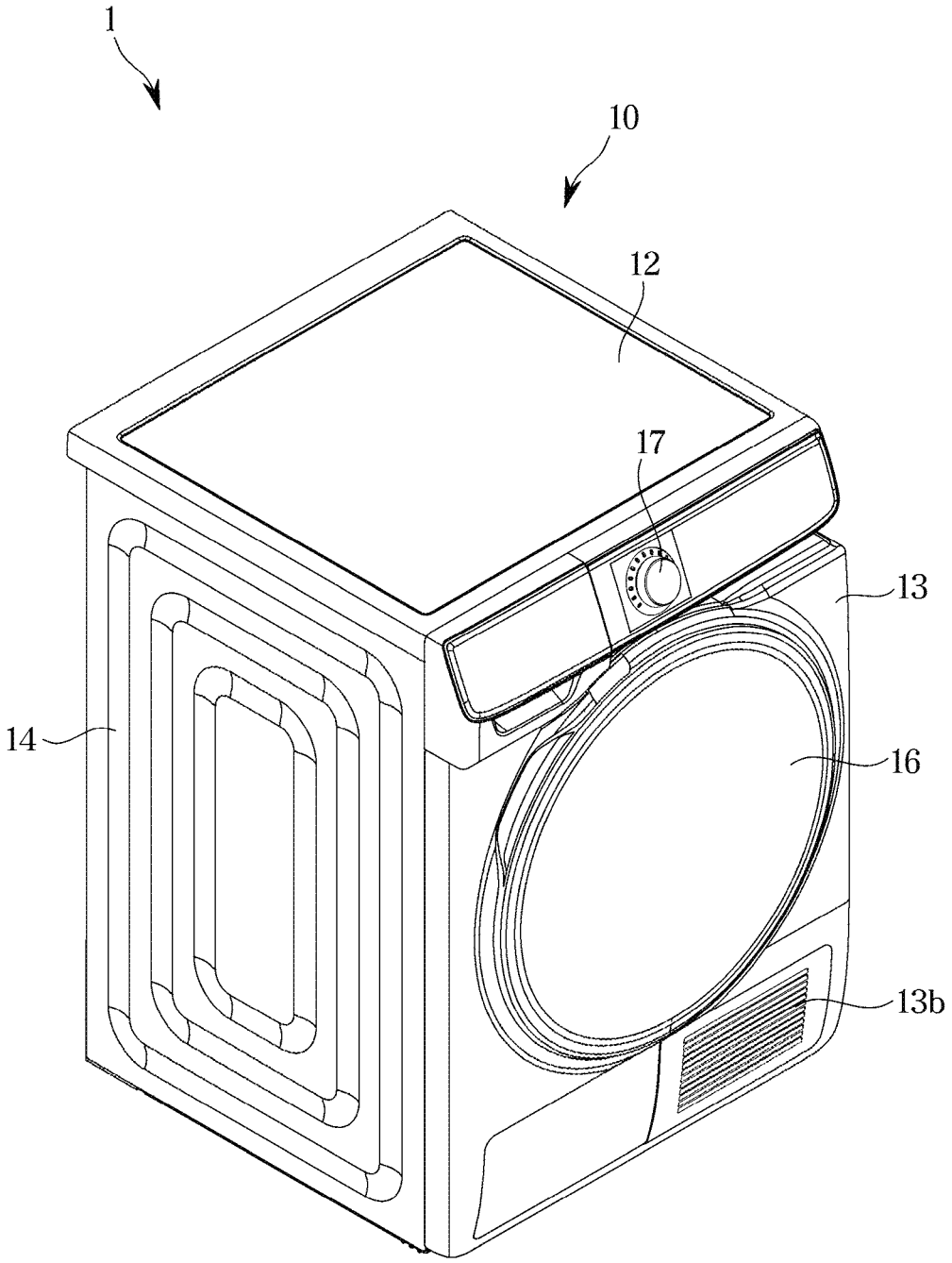
FIG. 1 is a perspective view illustrating an exemplary outer appearance of a clothing dryer according to an embodiment of the present disclosure.
Figure 2:
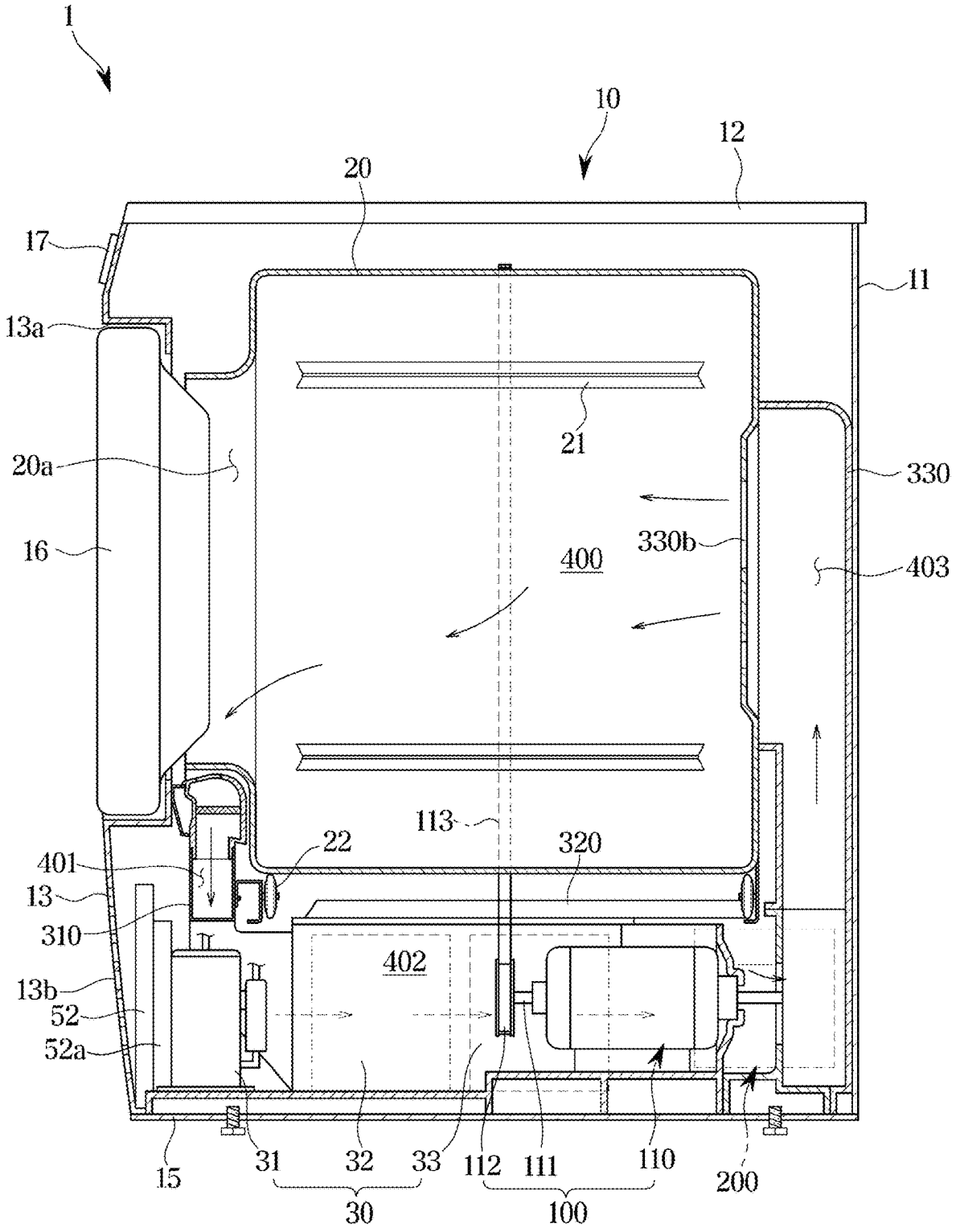
FIG. 2 is a cross-sectional view illustrating a clothing dryer according to an embodiment of the present disclosure.
Figure 3:
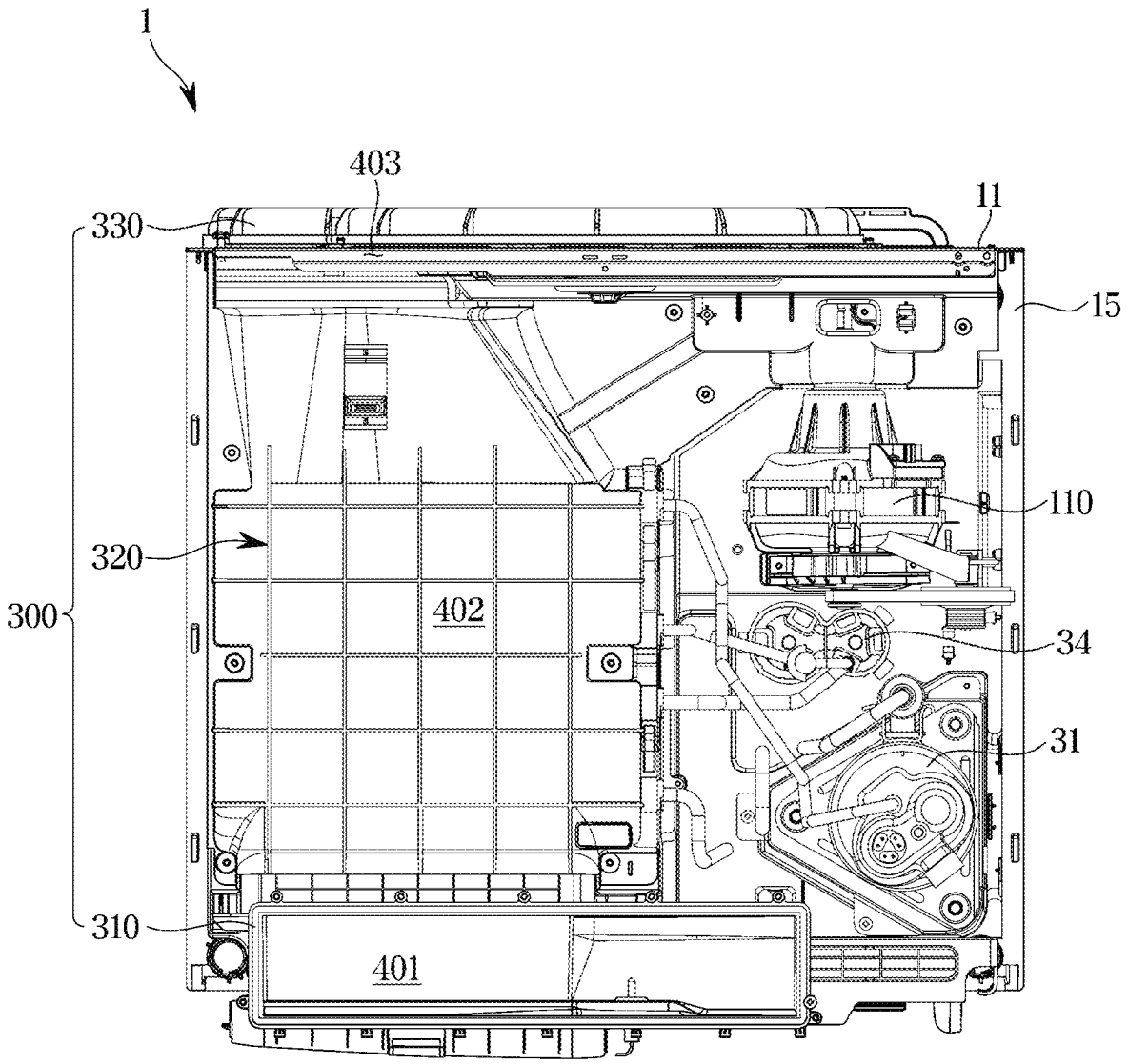
FIG. 3 is a plan view illustrating components mounted on a base of a clothing dryer according to an embodiment of the present disclosure.

FIG. 1 is a perspective view illustrating an outer appearance of a clothing dryer according to an embodiment of the present disclosure. FIG. 2 is a cross-sectional view illustrating a clothing dryer according to an embodiment of the present disclosure. FIG. 3 is a plan view illustrating components mounted on a base of a clothing dryer according to an embodiment of the present disclosure.

As shown in FIGS. 1 to 3, a clothing dryer 1 includes a main body 10 defining the outer appearance main body 10 and a drum 20 rotatably installed in the main body 10.

The main body 10 is formed approximately in hexahedral shape (box shape). Specifically, the main body 10 may include an upper plate 12, a front plate 13, a left side plate 14, a right-side plate (not shown), a rear plate 11, and a base 15. Although the front plate 13, the upper plate 12, the base 15, and the like constituting the main body 10 are exemplarily illustrated as being separately manufactured and assembled in the embodiment of the present disclosure, the scope of the present disclosure is not limited thereto. For example, at least some of the main body 10, the front plate 13, the upper plate 12, and the base 15 may be integrated with each other. Also, although the left side plate 14, the right side plate, and the rear plate 11 are exemplarily illustrated as being integrated with each other, the scope of the present disclosure is not limited thereto. For example, they may be manufactured separately and assembled.

The front plate 13 of the main body 10 is provided with an inlet 13*a* for introducing/withdrawing clothes (not shown), as objects to be dried, into/out of the drum 20. The inlet 13*a* may be opened or closed by a door 16. A control panel 17 may be provided at an upper portion of the main body 10 to control the operation of the clothing dryer 1.

A plurality of holes 13*b* may be formed at a lower portion of the front plate 13 of the main body 10. The plurality of holes 13*b* may be provided such that external air is introduced into the main body 10 and flow therein. A plurality of holes 11*b* may be formed at one or more portions of the rear plate 11 of the main body 10.

A blowing fan 52, which will be described later, may be disposed in the main body 10. External air introduced into the main body 10 by the blowing fan 52 may flow by the blowing fan 52 and be discharged out of the main body 10 through the plurality of holes 11*b* formed in the rear plate 11 of the main body 10.

External air may be introduced into the main body 10 through the plurality of holes 13*b* formed in the front plate 13 of the main body 10 and flow therein by the blowing fan 52.

The blowing fan 52 may be disposed at a front lower portion of the main body 10. The blowing fan 52 may be disposed to correspond to the plurality of holes 13*b* formed in the front plate 13 of the main body 10.

The drum 20 having a cylindrical shape may be installed in the main body 10. An opening 20*a* may be formed in the drum 20 to correspond to the inlet 13*a* formed open in the front plate 13 such that an object to be dried may be introduced/withdrawn into/out of the drum 20 therethrough.

The drum 20 may be provided inside the main body 10 to rotate about a rotating axis. Lifters 21 may be disposed on the inner peripheral wall of the main body 10 to lift the object to be dried while the drum 20 rotates. As the drum 20 rotates, the object to be dried may repeatedly be lifted and dropped by the lifters 21. Rollers 22 may be disposed on the outer peripheral wall of the drum 20 to support the drum 20 for smooth rotation of the drum 20.

The drum 20 is installed to rotate upon receiving power from a driving device 100. The driving device 100 may be disposed at a lower portion in the main body 10. The driving device 100 may be mounted on the base 15. The driving device 100 may include a first motor 110, a pulley 112 to transmit power of the first motor 110 to the drum 20, and a belt 113. The pulley 112 may be connected to a rotating shaft 111 connected to the first motor 110. When the rotating shaft 111 rotates by the first motor 110, the pulley 112 may rotate in accordance with the rotating shaft 111. The belt 113 may be installed wound around the outer surface of the pulley 112 and the outer surface of the drum 20. When the belt 113 rotates by a driving force of the first motor 110, the drum 20 may rotate together with the belt 113.

The drum 20 is provided to accommodate and dry the object to be dried. A duct 300 configured to form a flow path 400 for circulation of dry air into the drum 20 may be provided in the main body 10.

The duct 300 may include a hot air discharge duct 310 to discharge hot air that has passed through the drum 20, a hot air guide duct 330 to guide hot air to the drum 20, and a connection duct 320 to connect the hot air discharge duct 310 with the hot air guide duct 330.

The flow path 400 may be formed by air introduced into the drum 20 and air discharged from the drum 20.

The flow path 400 may include a discharge flow path 401 formed by the hot air discharge duct 310 provided to discharge hot air that has passed through the drum 20, a connection flow path 402 connected to the discharge flow path 401 and formed by the connection duct 320 that connects the hot air discharge duct 310 with the hot air guide duct 330, and a guide flow path 403 connecting the connection flow path 402 with the drum 20 and formed by the hot air guide duct 330 for guiding hot air to the drum 20.

The connection flow path 402 is configured to accommodate an evaporator 32 and a condenser 33 of a heat pump 30.

The duct 300 may be mounted on the base 15 disposed under the drum 20. The hot air discharge duct 310 may be located in front of and below the drum 20. The hot air guide duct 330 may be located behind the drum 20. The connection duct 320 may be located below the drum 20. The connection duct 320 may be mounted on the base 15.

The hot air guide duct 330 may be disposed behind the drum 20. Hot and dry air is supplied into the drum 20 through the hot air guide duct 330, and the object to be dried contained in the drum 20 may be dried by the hot and dry air. The hot and dry air turns to hot and humid air after drying the object to be dried, and the hot and humid air contained in the drum 20 may be discharged out of the drum 20 through the hot air discharge duct 310.

Figure 7:
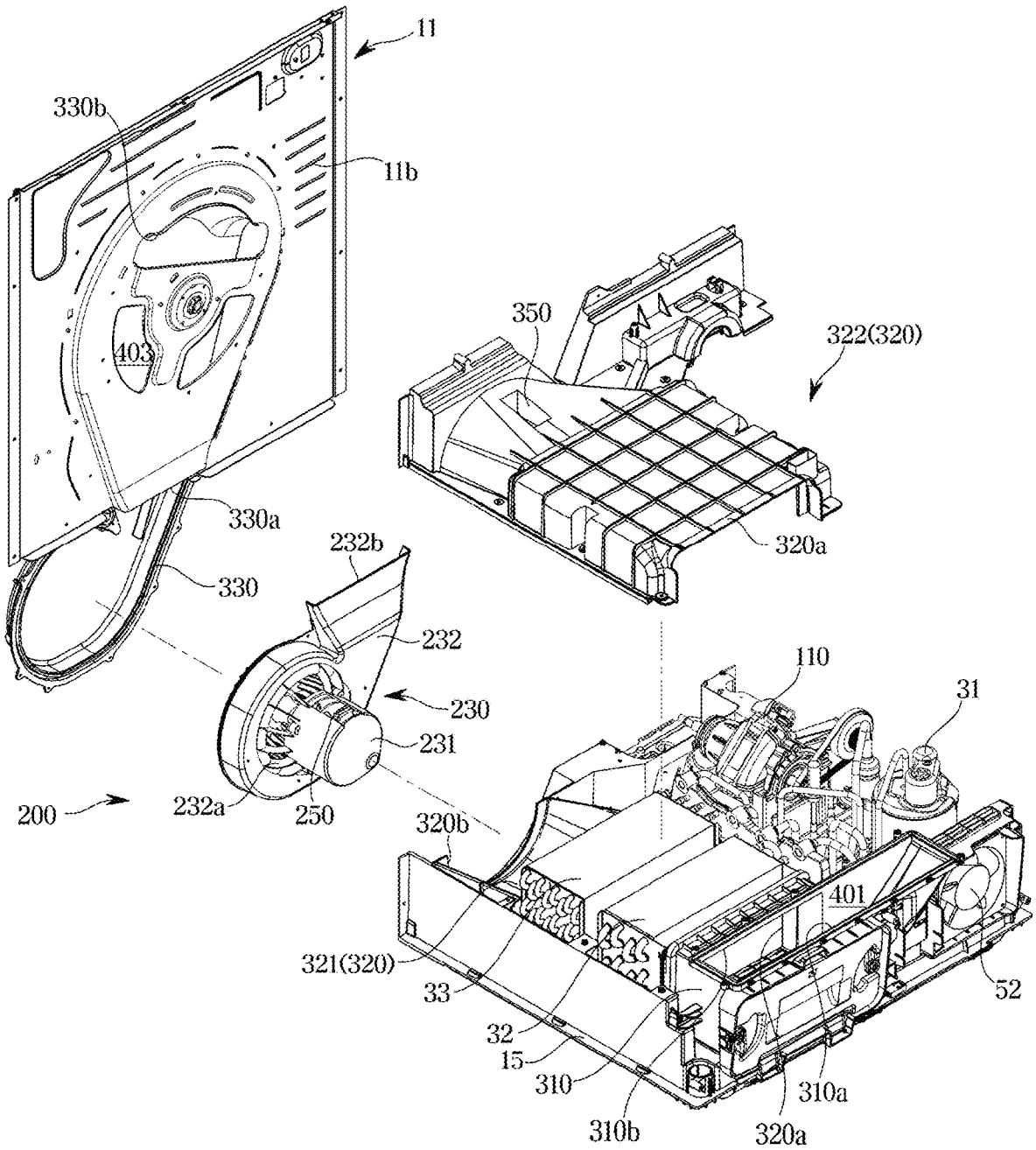
FIG. 7 is a view illustrating a heat pump and a duct mounted on a base and a rear plate according to an embodiment of the present disclosure.

The hot air discharge duct 310 may include a first hole (air inlet) 310*a* through which hot air of the drum 20 is introduced and a second hole 310*b* through which air introduced through the first hole 310*a* is discharged to the connection duct 320 (See FIG. 7).

A filter may be installed at the hot air discharge duct 310 to filter and remove foreign substances such as lint included in the hot air that has passed through the drum 20. Air obtained after drying the object to be dried contained in the drum 20 may be discharged out of the drum 20 through the hot air discharge duct 310. The air discharged through the hot air discharge duct 310 may be introduced into the connection duct 320.

Hot and humid air introduced into the duct 300 through the hot air discharge duct 310 is guided to the evaporator 32, which will be described later, and moisture may be removed from the hot and humid air.

The evaporator 32 may constitute the heat pump 30 together with a condenser 33, a compressor 31, and an expansion valve 34 which will be described later. The heat pump 30 is provided to dehumidify hot and humid air by cooling the air and then re-heat the cooled air while a refrigerant circulates.

Figure 4:
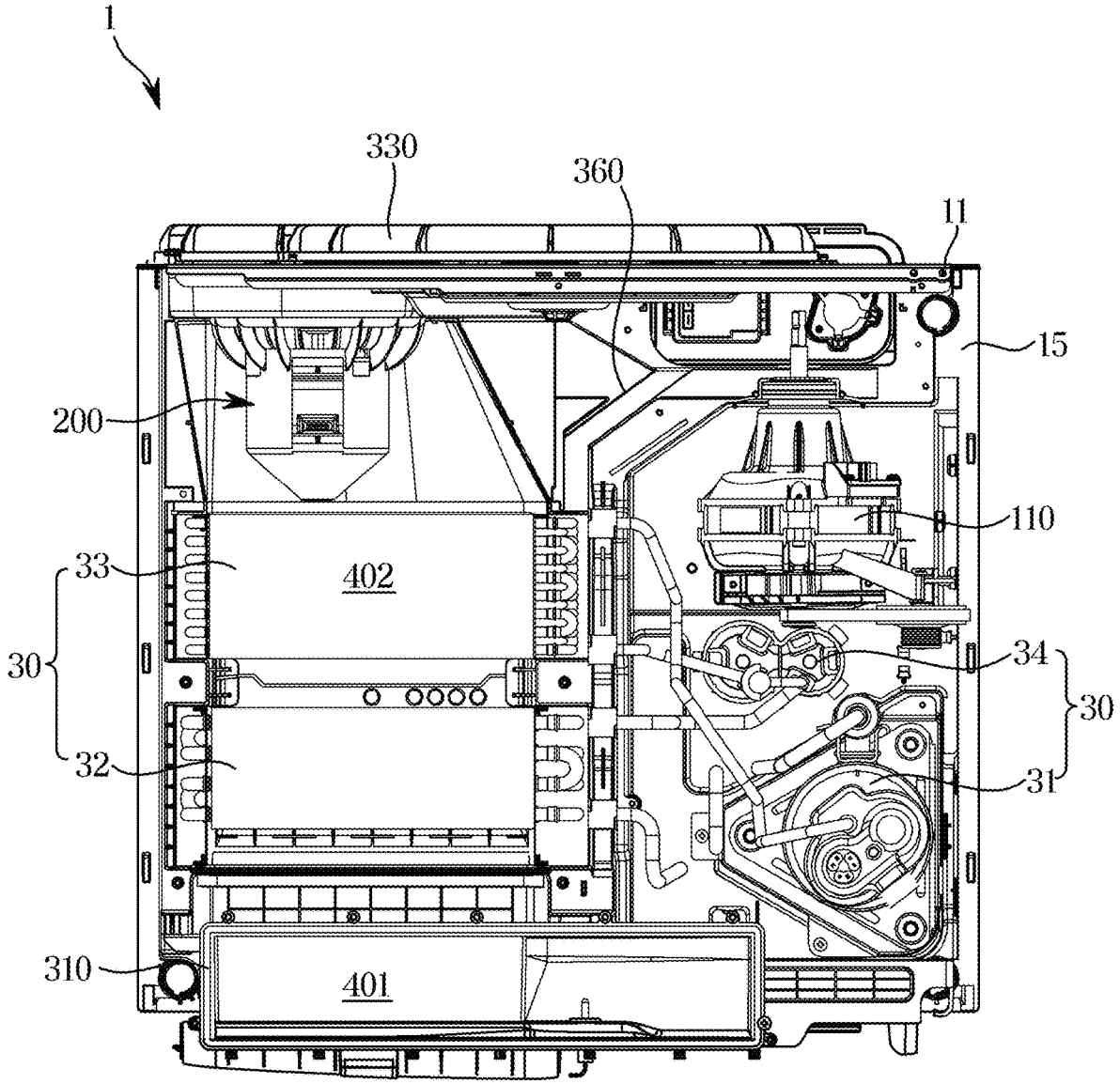
FIG. 4 is a view illustrating a heat pump, a first motor, and a second motor mounted on a base of a clothing dryer according to an embodiment of the present disclosure.
Figure 5:
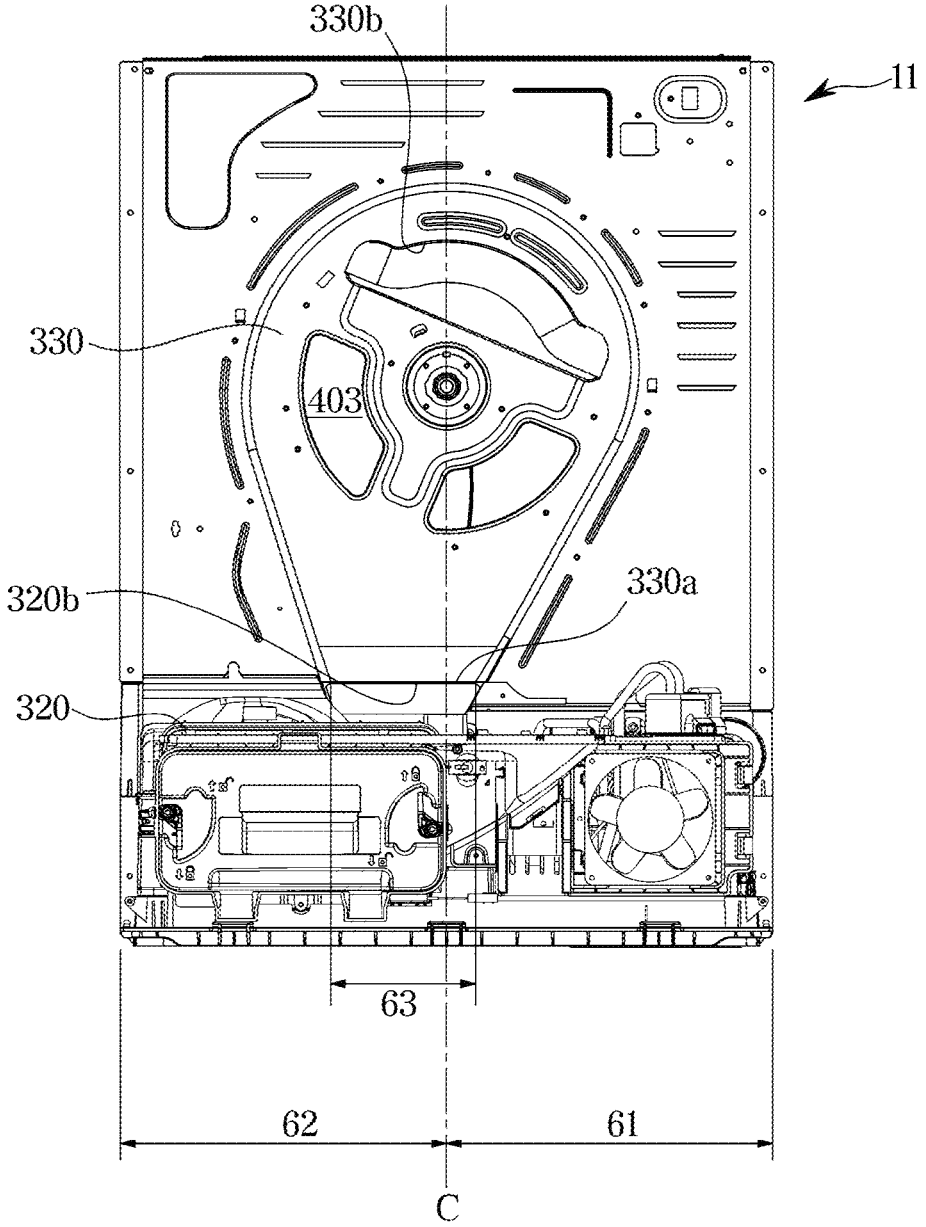
FIG. 5 is a view illustrating a heat pump, a first motor, a second motor, and a duct mounted on a base and a rear plate according to an embodiment of the present disclosure.

FIG. 4 is a view illustrating a heat pump, a first motor, and a second motor mounted on a base of a clothing dryer according to an embodiment of the present disclosure. FIG. 5 is a view illustrating a heat pump, a first motor, a second motor, and a duct mounted on a base and a rear plate according to an embodiment of the present disclosure.

As shown in FIGS. 4 and 5, the heat pump 30 may be installed on the base 15. The evaporator 32 and the condenser 33 of the heat pump 30 may be disposed at one portion of the base 15. The evaporator 32 and the condenser 33 of the heat pump 30 may be disposed in the duct 300. The evaporator 32 and the condenser 33 of the heat pump 30 may be disposed in the connection duct 320. The evaporator 32 and the condenser 33 of the heat pump 30 may be sequentially arranged in the connection duct 320 in the front-to-rear direction of the base 15.

The hot air discharge duct 310 located in front of and below the drum 20, the connection duct 320 located below the drum 20, and the hot air guide duct 330 located behind the drum 20 may be sequentially arranged in the front-to-rear direction of the base 15.

The hot air discharge duct 310, the connection duct 320, and the hot air guide duct 330 may be arranged in a straight line in the front-to-rear direction of the drum 20, thereby reducing flow path resistance. The flow path 400 formed by the hot air discharge duct 310, the connection duct 320, and the hot air guide duct 330 is aligned in a straight line from the front to the rear of the base 15, resulting in reduction of flow path resistance of air. Specifically, The discharge flow path 401, the connection flow path 402, and the guide flow path 403 may be aligned in a straight line from the front to the rear of the base 15 to reduce flow path resistance.

A blowing device 200 may be provided in the duct 300 to flow air. The blowing device 200 may include a fan 220 and a second motor 210 configured to drive the fan 220. The blowing device 200 may be located in the connection duct 320. The blowing device 200 may be located at a rear portion of the connection duct 320. The blowing device 200 may be located behind the evaporator 32 and the condenser 33. The blowing device 200 may be provided to circulate air in the flow path 400.

The compressor 31 and the expansion valve 34 of the heat pump 30 may be located the other portion of the base 15. The compressor 31 and the expansion valve 34 of the heat pump 30 may be disposed outside the duct 300. The compressor 31 and the expansion valve 34 of the heat pump 30 may be disposed outside the connection duct 320. The compressor 31 and the expansion valve 34 of the heat pump 30 may be mounted on one portion of the base 15 in the same line of the first motor 110.

The blowing fan 52 may be mounted on the base 15. The blowing fan 52 may be disposed at a front portion of the base 15. The blowing fan 52 may be located at a lower portion behind the front plate 13. The blowing fan 52 may receive power from a third motor. The third motor is configured to circulate air inside the main body 10 by rotating the blowing fan 52. The blowing fan 52 may be located at a position corresponding to the plurality of holes 13*b* formed in the front plate 13. The blowing fan 52 and the third motor may be aligned in a straight light where the compressor 31, the expansion valve 34, and the first motor 110 are arranged. Air introduced into the main body 10 by the blowing fan 52 may cool the inside of the base 15, i.e., the compressor 31, the expansion valve 34, and the first motor 110, and may be discharged through the plurality of holes 11*b* formed in the rear plate 11 of the main body 10.

The base 15 may have a first region 61 in which the first motor 110 is located and a second region 62 other than the first region 61. The first region 61 and the second region 62 may be formed on the left and right sides with respect to the center C of the base 15. Although the first region 61 is exemplarily illustrated as being located on the right side of the base 15 and the second region 62 is exemplarily illustrated as being located on the left side of the base 15 in an embodiment of the present disclosure, the scope of the present disclosure is not limited thereto.

The first region 61 may be formed on one side of the base 15, and the second region 62 may be formed on the other side of the base 15. The first motor 110 to drive the drum 20 may be located in the first region 61 of the base 15. The blowing fan 52, the third motor, the compressor 31 and the expansion valve 34 of the heat pump 30, and the first motor 110 may be arranged in the first region 61 of the base 15. The hot air guide duct 330, the evaporator 32 and the condenser 33 of the heat pump 30, and the connection duct 320 covering the second motor 210 may be arranged in the second region 62 of the base 15.

The connection duct 320 may be disposed in the second region 62 of the base 15. The hot air discharge duct 310 configured to discharge hot air that has passed through the drum 20 is located at a front portion of the base 15 so as to overlap the first region 61 and the second region 62 of the base 15. At least one portion of the hot air discharge duct 310 may be disposed in the second region 62. The hot air discharge duct 310 may be eccentrically disposed in the second region 62. The hot air discharge duct 310 may be configured to be connected to the connection duct 320.

The connection duct 320 may include an air inlet (hereinafter, referred to as a first connection hole 320*a*), which will be described later, for supplying air that has passed through the drum 20. The first connection hole 320*a* of the connection duct 320 may be disposed in the second region 62 of the base 15. The first connection hole 320*a* of the connection duct 320 may be eccentrically disposed from the center C of the base 15.

The connection duct 320 may include an air outlet (hereinafter, referred to as a second connection hole 320*b*), which will be described later, for discharging internal air. The second connection hole 320*b* may be connected to a first guide hole 330*a* of the hot air guide duct 330 to guide the air from the connection duct 320 to the drum 20 through the hot air guide duct 330. The second connection hole 320*b* for discharging the air from the connection duct 320 may be disposed in a third region 63. The third region 63 may be located to overlap the second region 62 and the first region 61. The third region 63 may be located eccentrically to the second region 62. The second connection hole 320*b* for discharging air from the connection duct 320 may be disposed on at least one portion of the second region 62. The second connection hole 320*b* of the connection duct 320 may be disposed eccentrically from the center C of the base 15. Air introduced through the guide hole 330*a* of the hot air guide duct 330 corresponding to the second connection hole 320*b* of the connection duct 320 may be discharged to the drum 20 through the second guide hole 330*b* of the hot air guide duct 330.

Thus, the hot air discharge duct 310 configured to guide air discharged from the inside of the drum 20 to the connection duct 320, the connection duct 320 configured to allow the air supplied from the hot air discharge duct 310 to pass through the evaporator 32 and the condenser 33, and the hot air guide duct 330 configured to re-supply the air discharged from the connection duct 320 to the drum 20 may be sequentially aligned in the second region 62 of the base 15. By using the hot air discharge duct 310, the connection duct 320, and the hot air guide duct 330 aligned in a row in the second region 62 of the base 15, the flow path 400 may be simplified to reduce flow path resistance.

Figure 6:
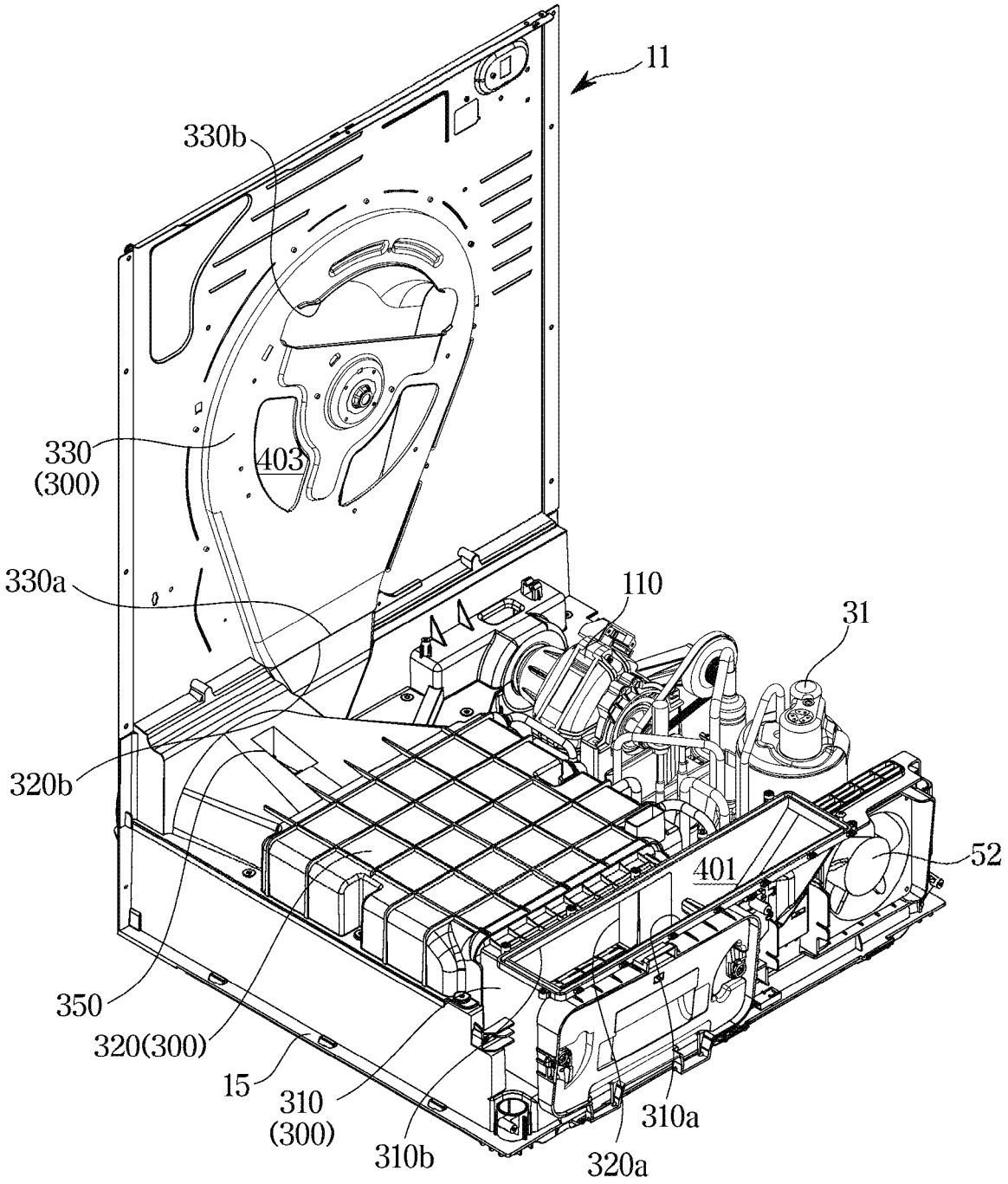
FIG. 6 is a perspective view illustrating a duct and a heat pump mounted on a base and a rear plate according to an embodiment of the present disclosure.

FIG. 6 is a perspective view illustrating a duct and a heat pump mounted on a base and a rear plate according to an embodiment of the present disclosure. FIG. 7 is a view illustrating a heat pump and a duct mounted on a base and a rear plate according to an embodiment of the present disclosure.

As shown in FIGS. 6 and 7, the duct 300 mounted on the base 15 may be configured to form a flow path 400 for circulating dry air into the drum 20.

The duct 300 may include the hot air discharge duct 310, a connection duct 320, and the hot air guide duct 330. Each of the hot air discharge duct 310, the connection duct 320, and the hot air guide duct 330 may form the flow path 400.

The flow path 400 may include a discharge flow path 401 formed by the hot air discharge duct 310 to discharge hot air that has passed through the inside of the drum 20, a connection flow path 402 connected to the discharge flow path 401 and formed by the connection duct 320 that connects the hot air discharge duct 310 with the hot air guide duct 330, and a guide flow path 403 connecting the connection flow path 402 with the drum 20 and formed by the hot air guide duct 330 to guide hot air to the drum 20.

The discharge flow path 401 is formed in front of and below the drum 20. Hot and humid air introduced into the discharge flow path 401 formed by the hot air discharge duct 310 flows into the connection flow path 402 by the connection duct 320. Air inside the connection flow path 402 turns to hot and dry air via heat exchange while passing through the evaporator 32 and the condenser 33 and the hot and dry air may be supplied to the drum 20 through the guide flow path 403 formed by the hot air guide duct 330. The hot air discharge duct 310 may have the first hole (air inlet) 310*a* to introduce hot air of the drum 20 and the second hole 310*b* to discharge the air introduced through the first hole 310*a* to the connection duct 320. The second hole 310*b* may be connected to the first connection hole 320*a* of the connection duct 320.

The hot air guide duct 330 may have the guide hole 330*a* to introduce hot and dry air of the connection flow path 402 and the second guide hole 330*b* formed to discharge the air introduced into the hot air guide duct 330 through the guide hole 330*a* to the drum 20. The second guide hole 330*b* may be formed to be connected to the drum 20.

The connection duct 320 disposed between the hot air guide duct 330 and the hot air discharge duct 310 is provided to allow hot and humid air that has passed through the inside of the drum 20 to flow toward the evaporator 32.

The evaporator 32 and the condenser 33 may be located in the connection duct 320. The evaporator 32 may constitute the heat pump 30 together with the condenser 33, the compressor 31, and the expansion valve 34.

The heat pump 30 is provided to dehumidify hot and humid by cooling the air and re-heat the air while a refrigerant circulates. The evaporator 32 dehumidifies hot and humid air by cooling the air. Condensate formed while the evaporator 32 dehumidifies air may be collected below the evaporator 32 and discharged to the outside.

The evaporator 32 includes a plurality of heat dissipation fins (not shown) spaced apart from each other and overlapping each other and a refrigerant pipe (not shown) penetrating the heat dissipation fins. The plurality of heat dissipation fins overlap each other to form a channel through which air passes.

After receiving heat from hot air in the evaporator 32, the refrigerant of the heat pump 30 is compressed in the compressor 31 and supplied to the condenser 33. The air dehumidified by the evaporator 32 is introduced into the condenser 33 and heated by the refrigerant, and then re-introduced into the drum 20.

Since heat exchange occurs between air and the refrigerant by the evaporator 32 and the condenser 33 of the heat pump 30 to produce hot and dry air, the evaporator 32 and the condenser 33 may be referred to as a heat exchanger.

The hot and dry air obtained by the evaporator 32 and the condenser 33 may be re-introduced into the drum 20 through the blowing device 200 located in the connection duct 320. The blowing device 200 may be disposed between the connection duct 320 and the hot air guide duct 330. Although the blowing device 200 is exemplarily illustrated as being located at an end of the hot air guide duct 330 and at a rear end portion of the connection duct 320, but the scope of the present disclosure is not limited thereto. For example, the blowing device 200 may be located at another position of the connection duct 320.

The connection duct 320 may include a first connection duct 321 installed at the base 15 and a second connection duct 322 coupled to the first connection duct 321. The evaporator 32 and the condenser 33 of the heat pump 30 may be disposed between the first connection duct 321 and the second connection duct 322.

One end of the connection duct 320 may be connected to the hot air discharge duct 310, and the other end may be connected to the hot air guide duct 330. The connection duct 320 may include the first connection hole formed to be connected to the hot air discharge duct 310 and the second connection hole 320*b* formed to be connected to the hot air guide duct 330. The first connection hole 320*a* and the second connection hole 320*b* may be formed to correspond to the first connection duct 321 and the connection duct 320, respectively and may be connected with each other by coupling between the first connection duct 321 and the second connection duct 322.

The first connection duct 321 is formed such that the evaporator 32 and the condenser 33 are installed therein. The first connection duct 321 may be formed such that the blowing device 200 is installed therein. Although the first connection duct 321 is exemplarily illustrated as being separately formed from the base 15 in an embodiment of the present disclosure, the scope of the present disclosure is not limited thereto.

The second connection duct 322 may be coupled to the first connection duct 321 to cover the evaporator 32 and the condenser 33. The second connection duct 322 is provided to accommodate the blowing device 200. The second connection duct 322 is provided to cover the blowing device 200.

A first heat dissipation port 350 may be formed at the second connection duct 322 for heat dissipation of the blowing device 200 disposed in the connection duct 320. During the operation of the clothing dryer 1, the inside of the connection duct 320 is maintained at a high temperature. Since the blowing device 200 is disposed in the connection duct 320, long-term exposure to hot air may result in occurrence of failure and decrease in lifespan thereof. The first heat dissipation port 350 may be formed to dissipate heat of the blowing device 200. The first heat dissipation port 350 may be formed at a position corresponding to the second motor 210 of the blowing device 200. The first heat dissipation port 350 may be formed at a position corresponding to a motor bracket 230, which will be described later, and the second heat dissipation port 250.

The connection duct 320 may include a partition wall 360 such that the blowing device 200 disposed therein is separated from the first motor 110 of the driving device 100. The partition wall 360 may be formed in the first connection duct 321. The partition wall 360 may be formed in the second connection duct 322. The partition wall 360 may be formed to respectively correspond to the first connection duct 321 and the second connection duct 322. The first motor 110 of the driving device 100 may be separated from the second motor 210 of the blowing device 200 by the partition wall 360. Since the second motor 210 disposed to be separated from the first motor 110 may generate an air flow sufficient for the operation of the clothing dryer 1, noise may be reduced.

The second motor 210 may be disposed in the connection duct 320. The second motor 210 may be installed in the motor bracket 230.

Figure 8:
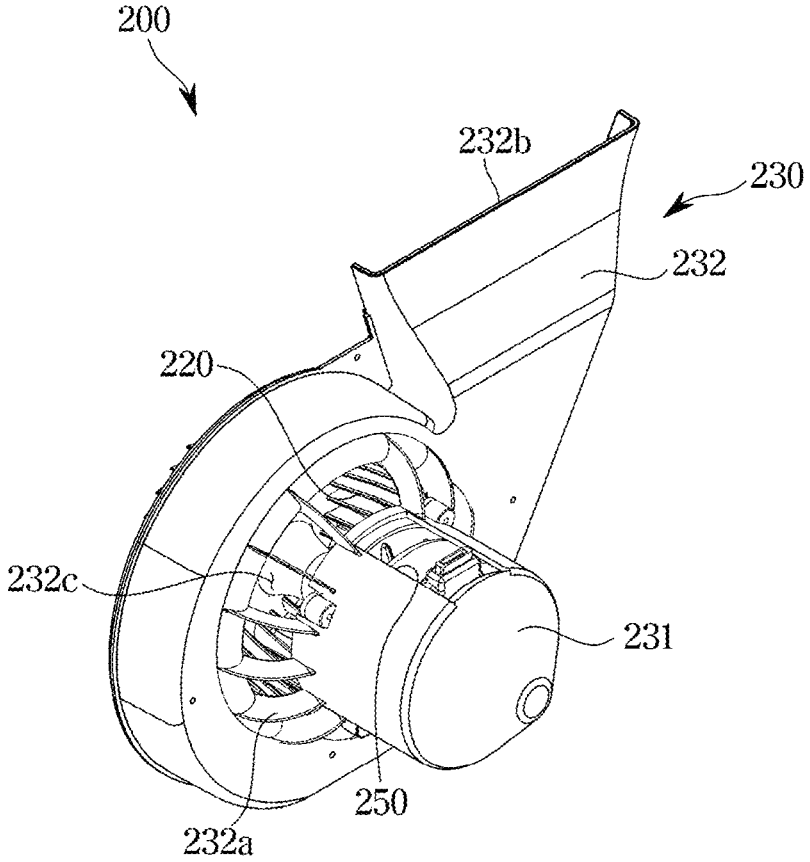
FIG. 8 is a perspective view illustrating a second motor of a clothing dryer according to an embodiment of the present disclosure.

FIG. 7 is a perspective view illustrating a second motor of a clothing dryer according to an embodiment of the present disclosure. FIG. 8 is an exploded perspective view illustrating a second motor according to an embodiment of the present disclosure.

As shown in FIGS. 7 and 8, the blowing device 200 may include a fan 220 and a second motor 210 configured to drive the fan 220.

The second motor 210 may be in a state of being accommodated in the motor bracket 230 installed in the connection duct 320.

When the clothing dryer 1 operates, the inside of the connection duct 320 is maintained at a high temperature. Since the blowing device 200 is disposed in the connection duct 320, long-term exposure to hot air may result in occurrence of failure and decrease in lifespan thereof. Since the second motor 210 is accommodated in the motor bracket 230, the second motor 210 may not be directly exposed to the high temperature inside the connection duct 320.

The second motor 210 is configured to rotate the fan 220. The fan 220 may be provided for air circulation in the connection duct 320. The fan 220 may be provided for circulation of air that has passed through the evaporator 32 and the condenser 33 disposed inside the connection duct 320. The fan 220 may be provided to suction air that has passed through the evaporator 32 and the condenser 33 inside the connection duct 320. The fan 220 may be connected to a motor axis 211 of the second motor 210. Air suctioned by the fan 220 may be re-introduced into the drum 20 through the hot air guide duct 330. The second motor 210 may be disposed in a row with the first motor 110. The motor axis 211 of the second motor 210 may be located parallel to the rotating shaft 111 of the first motor 110. The second motor 210 may be disposed in the connection duct 320. The second motor 210 may be disposed in the second region 62 of the base 15, i.e., eccentrically disposed from the center C of the base 15. The second motor 210 may be located at the opposite side of the first motor 110 disposed in the first region 61 of the base 15.

The motor bracket 230 for accommodating the second motor 210 may be disposed in the second region 62. The motor bracket 230 may include a motor accommodating portion 231 to accommodate the second motor 210 and a guide duct 232 extending from the motor accommodating portion 231 to guide air to the hot air guide duct 330. The accommodating portion 231 of the motor bracket 230 may be formed in a shape corresponding to that of the second motor 210 such that the second motor 210 is accommodated therein. Although the second motor 210 formed in a cylindrical shape is exemplarily illustrated in an embodiment of the present disclosure, the scope of the present disclosure is not limited thereto. For example, the second motor may also be formed in a square pillar shape.

An anti-vibration member 260 may be provided between the accommodating portion 231 of the motor bracket 230 and the second motor 210 to reduce vibration and noise of the second motor 210. The anti-vibration member 260 may be formed in a ring shape. The anti-vibration member 260 may be formed of an elastic material, The anti-vibration member 260 may include a material such as rubber and silicone. Although the anti-vibration member 260 having a ring shape is exemplarily illustrated in an embodiment of the present disclosure, the shape of the anti-vibration member 260 may vary according to the motor accommodating portion 231 and the second motor 210.

The motor accommodating portion 231 may include a second heat dissipation port 250 formed by opening at least one portion thereof. The second heat dissipation port 250 may be formed by opening at least one portion of the top surface of the motor accommodating portion 231. The second heat dissipation port 250 may be formed for dissipating heat of the second motor 210. The second heat dissipation port 250 may be formed at a position corresponding to the first heat dissipation port 350 of the connection duct 320.

A guide rib 232*a* that forms a duct inlet 232*c* for air flow in the connection duct 320 may be formed at the guide duct 232. The guide rib 232*a* may include a plurality of ribs radially located at the accommodating portion 231 to be spaced apart from each other. Air inside the connection duct 320 may be guided by the guide rib 232*a* and suctioned by the fan 220 through the guide duct inlet 232*c*, and then flow to the hot air guide duct 330 through a guide duct outlet 232*b* of the guide duct 232.

Figure 9:
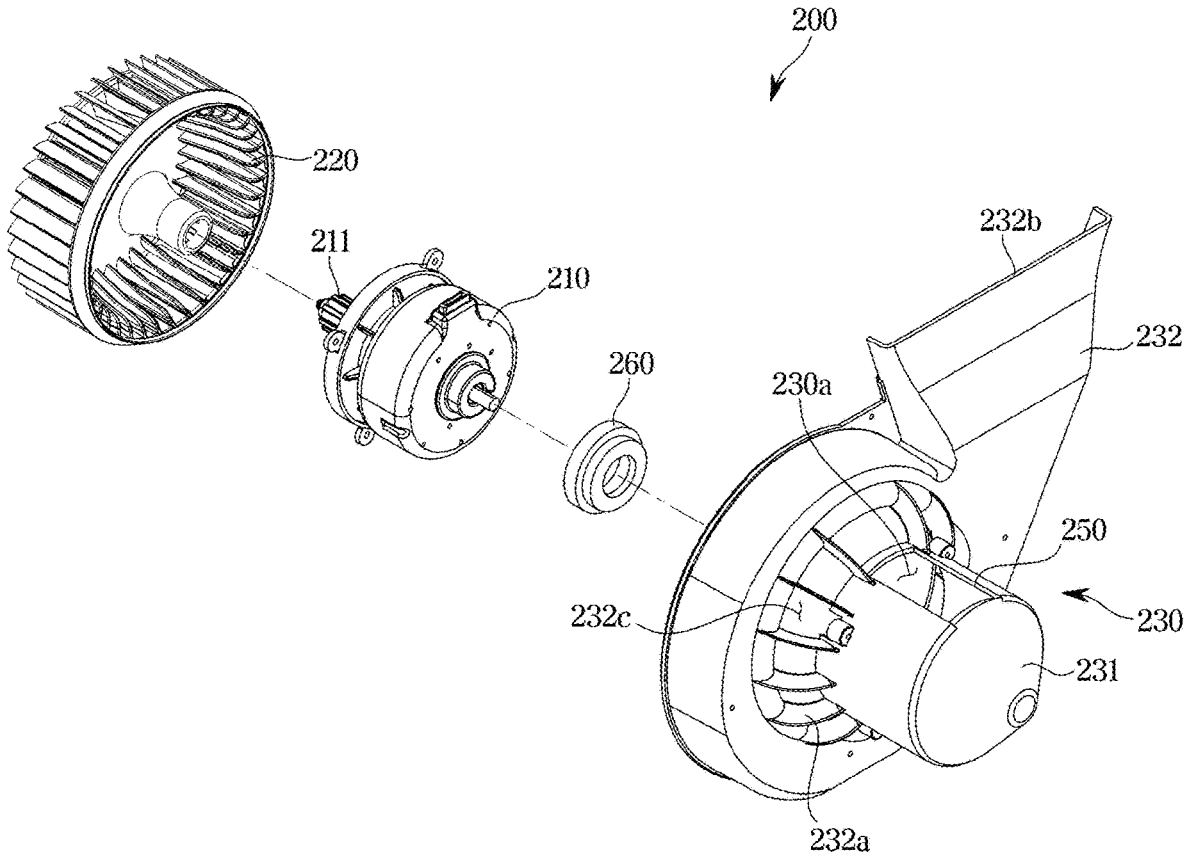
FIG. 9 is an exploded perspective view illustrating a second motor according to an embodiment of the present disclosure.
Figure 10:
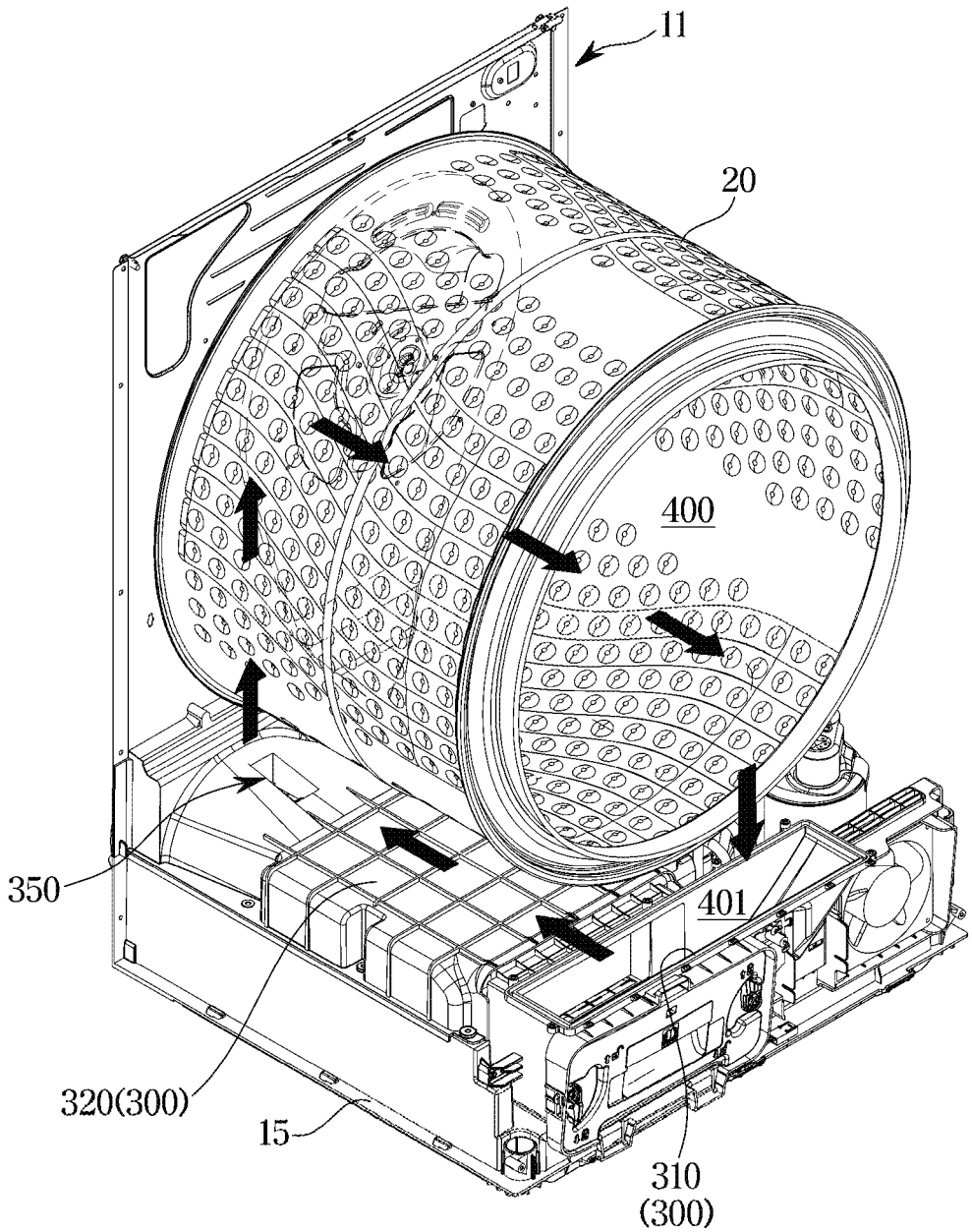
FIG. 10 is a view illustrating a flow path of air circulated by a second motor according to an embodiment of the present disclosure.

FIG. 9 is an exploded perspective view illustrating a second motor according to an embodiment of the present disclosure. FIG. 10 is a view illustrating a flow path of air circulated by a second motor according to an embodiment of the present disclosure.

The flow path 400 connected to the drum 20 and configured to circulate air may include the discharge flow path 401 formed by the hot air discharge duct 310 configured to discharge hot air that has passed through the inside of the drum 20, the connection flow path 402 connected to the discharge flow path 401 and formed by the connection duct 320 connecting the hot air discharge duct 310 with the hot air guide duct 330, and the guide flow path 403 connecting the connection flow path 402 with the drum 20 and formed by the hot air guide duct 330 provided to guide hot air to the drum 20.

The discharge flow path 401 is formed in front of and below the drum 20. Hot and humid air introduced into the discharge flow path 401 formed by the hot air discharge duct 310 flows into the connection flow path 402 by the connection duct 320.

Air in the connection flow path 402 turns to hot and dry air via heat exchange while passing through the evaporator 32 and the condenser 33 and the hot and dry air may be supplied to the drum 20 through the guide flow path 403 formed by the hot air guide duct 330.

In this regard, since the connection flow path 402 is linearly formed in the front-to-rear direction of the drum 20, the flow path may be simplified, thereby reducing flow path resistance.

According to an embodiment, the effect on reducing an air flow loss may be obtained by improving an air flow.

Also, the effect on reducing flow resistance may be obtained by simplifying the structure of the flow path.

In addition, the effect on reducing noise and spatial limitations may be obtained by installing a fan motor in the flow path.

Although the present disclosure has been described with various embodiments, various changes and modifications may be suggested to one skilled in the art. It is intended that the present disclosure encompass such changes and modifications as fall within the scope of the appended claims.

What is claimed is:

1. A clothing dryer comprising:
- a main body;
- a drum rotatably installed in the main body;
- a first motor configured to transmit a rotational force to the drum;
- a heat pump configured to heat air supplied into the drum and comprising an evaporator, a compressor, a condenser, and an expansion valve;
- a flow path connected to the drum to circulate air;
- a second motor disposed in the flow path and configured to drive a fan for flowing air; and
- a duct forming the flow path,
- wherein the second motor is located in the duct, and
- wherein the duct comprises:
  - a hot air discharge duct connected to the drum to discharge air from the drum,
  - a connection duct connected to the hot air discharge duct and forming a connection flow path,
  - a hot air guide duct connected to the connection duct and configured to guide air sequentially through the evaporator, the condenser, and the second motor and resupply the air to the drum, and
  - a first heat dissipation port configured to dissipate heat of the second motor.

2. The clothing dryer of claim 1, wherein:
the flow path comprises the connection flow path to accommodate the evaporator and the condenser,
the connection flow path comprises an air outlet to discharge air toward the drum, and
the air outlet is eccentrically located closer to the condenser than the first motor.

3. The clothing dryer of claim 2, wherein the air outlet is located in a line where the second motor is located.

4. The clothing dryer of claim 1, wherein:
the clothing dryer comprises:
a first region in which the first motor is located, and
a second region located parallel to the first region, and
wherein the second motor is located in the second region.

5. The clothing dryer of claim 1, wherein an axis of the second motor is arranged parallel to a rotating shaft of the first motor.

6. The clothing dryer of claim 1, wherein the clothing dryer further comprises a motor bracket configured to accommodate the second motor.

7. The clothing dryer of claim 6, wherein the motor bracket is configured to cover at least one portion of the second motor and comprises a second heat dissipation port to dissipate heat of the second motor.

8. The clothing dryer of claim 7, wherein the first heat dissipation port and the second heat dissipation port are formed at positions corresponding to each other.

9. The clothing dryer of claim 6, wherein the motor bracket further comprises an anti-vibration member to reduce vibration between the motor bracket and the second motor.

10. The clothing dryer of claim 1, wherein the flow path comprises:
a discharge flow path connecting the drum with the connection duct,
the connection flow path connected to the discharge flow path and sequentially accommodating at least one component of the heat pump and the second motor, and
a guide flow path connecting the connection flow path with the drum.

11. The clothing dryer of claim 10, further comprising a motor bracket, wherein the motor bracket comprises a guide duct to guide air of the connection flow path to the drum.

12. A clothing dryer comprising:
a drum rotatably installed in a main body;
a duct connected to the drum and forming a flow path for air circulation;
a heat pump configured to heat air supplied to the drum and comprising an evaporator, a compressor, a condenser, and an expansion valve;
a first motor configured to drive the drum; and
a second motor configured to drive a fan provided to flow air in the flow path,
wherein the second motor is located in the duct,
wherein the duct comprises:
a hot air discharge duct connected to the drum to discharge air from the drum,
a connection duct connected to the hot air discharge duct and forming a connection flow path, and
a hot air guide duct connected to the connection duct and configured to guide air sequentially through the evaporator, the condenser, and the second motor and resupply air to the drum,
wherein the first motor and the second motor are arranged to have axes parallel to each other, and
wherein the duct comprises a first heat dissipation port configured to dissipate heat of the second motor.

13. The clothing dryer of claim 12, wherein the second motor is eccentrically arranged closer to the condenser.

14. The clothing dryer of claim 12, wherein:
the flow path comprises the connection flow path accommodating the evaporator and the condenser,
the connection flow path comprises an air outlet to discharge air toward the drum, and
the air outlet is disposed closer to the condenser than the first motor.

15. The clothing dryer of claim 12, wherein:
the clothing dryer comprises a motor bracket configured to accommodate the second motor, and
the motor bracket comprises:
a guide duct configured to guide air of the flow path to the drum, and
a second heat dissipation port configured to dissipate heat of the second motor.

* * * * *